US011781777B2

(12) United States Patent
Taylor

(10) Patent No.: US 11,781,777 B2
(45) Date of Patent: Oct. 10, 2023

(54) DUCTING SYSTEM FOR HVAC APPLICATION

(71) Applicant: Super Heat Incorporated, Mount Bethel, PA (US)

(72) Inventor: Paul Taylor, Mount Bethel, PA (US)

(73) Assignee: Super Heat Incorporated, Mount Bethel, PA (US)

( * ) Notice: Subject to any disclaimer, the term of this patent is extended or adjusted under 35 U.S.C. 154(b) by 79 days.

(21) Appl. No.: 17/155,853

(22) Filed: Jan. 22, 2021

(65) Prior Publication Data

US 2022/0235964 A1 Jul. 28, 2022

(51) Int. Cl.
*F24F 13/02* (2006.01)

(52) U.S. Cl.
CPC ..... *F24F 13/0281* (2013.01); *F24F 13/0209* (2013.01); *F24F 13/0245* (2013.01); *F24F 13/0263* (2013.01)

(58) Field of Classification Search
CPC ..... F24F 13/0281; F24F 13/0209; F24F 13/0245; F24F 13/0263
USPC ..... 138/163, 112
See application file for complete search history.

(56) References Cited

U.S. PATENT DOCUMENTS 2,916,054 A * 12/1959 Callan ..... F16L 23/14 285/364
5,660,212 A * 8/1997 Elder ..... F16L 23/14 138/172
6,349,976 B1 * 2/2002 Taylor, Jr. ..... F16L 59/14 285/47
7,699,078 B1 * 4/2010 Husmann, Jr. ..... F16L 59/04 138/148
10,591,180 B2 * 3/2020 Wasniewski ..... F24F 13/0281
10,976,070 B1 * 4/2021 Albers ..... F24F 13/0263
2005/0116470 A1 * 6/2005 Duffy ..... F16L 59/145 285/424
2007/0181204 A1 * 8/2007 Stout ..... F16L 59/147 138/155
2015/0101697 A1 * 4/2015 Duffy ..... F24F 13/0209 138/109
2017/0130984 A1 * 5/2017 Duffy ..... F16L 9/003
2019/0219299 A1 * 7/2019 Lubratt ..... F24F 13/0281
2020/0049366 A1 * 2/2020 Harris ..... F24F 13/0245

* cited by examiner

*Primary Examiner* — Craig M Schneider
*Assistant Examiner* — David R Deal
(74) *Attorney, Agent, or Firm* — Young Basile Hanlon & MacFarlane, P.C.

(57) ABSTRACT

A ducting system for a heating ventilation and air conditioning (HVAC) application includes a duct assembly having an inner duct member, and an outer duct member disposed around the inner duct such that the outer and inner duct members together define a pre-determined amount of space therebetween. The ducting system also includes a bonding and insulation composite that is disposed in the pre-determined amount of space between the inner and outer duct members to insulate the inner and outer duct members from each other yet adhesively bond with each of the inner and outer duct members for imparting structural rigidity to the duct assembly.

16 Claims, 12 Drawing Sheets

DUCTING SYSTEM FOR HVAC APPLICATION

TECHNICAL FIELD

The presently disclosed subject matter generally relates to a component for use in heating ventilation and air conditioning (HVAC) applications. Particularly, the present subject matter relates to an insulated ducting system for use in HVAC applications.

BACKGROUND

HVAC applications typically employ ducting for purposes of routing air from one location to another. For example, in an air conditioning or heating system, the heated or cooled air may need to be transported from an air handler positioned on an exterior of a building, or another unconditioned space, to multiple locations within the building. This requires that the ducting be insulated from any exterior temperatures. Ever increasing stringent norms such as the federal and state guidelines of various jurisdictions mandate that an R-value for the duct work be based off the temperature variations recommended by the climate zone map of the Department of Energy.

Many ducting systems have been developed in the past to overcome the drawback of applying excessive manual effort that is typically required during installation of an insulated ducting system for a HVAC application. One traditionally implemented approach for installing a duct is by oversizing the duct beforehand so that an inner perimeter of the oversized duct is rendered large enough to accommodate an insulating liner therein. One of the many drawbacks with this traditionally known approach is that inner edges of the duct would then also need to have fasteners that are installed with a spot welder, or screws, while the insulating liner, typically, mineral wool, may be glued and pressed over the fasteners to secure the insulating liner to the inner perimeter of the duct. This process of fastening and gluing the insulating liner entails a significantly increased amount of time and effort by an experienced technician for making and/or assembling the duct prior to installation and use in the HVAC application.

Besides, with the foregoing method of installing the duct, the insulation would remain subject to moisture and temperature changes within the air stream of the duct when in operation. Owing to this, the insulation liner and/or the glue holding the insulation liner to the inner perimeter of the duct can come undone upon prolonged exposure to the moisture and temperature changes that are also concomitantly encountered with changes in weather. At the least, the insulation liner could likely be subject to mold as well when exposed to moisture. Moreover, the insulation liner may also prevent the technicians or workers from performing one or more service routines such as cleaning an interior of the duct as the cleaning process itself may inadvertently deteriorate, or even remove, the insulation from the inner perimeter of the duct.

Another approach to ducting is to install the insulation layer, in this case—a grade of exterior rated foam such as Johns Manville AP™ Foil-Faced Polyiso Foam Sheathing that is suitable for exterior use, on exterior surfaces of the duct. The insulation layer may be glued, or screwed, to the exterior surface of the duct and wrapped using an adhesive coated aluminum cladding. However, this method requires a skilled technician to first cut individual pieces of the foam to form a board to each side of the duct, then wrap the boards with the cladding, and smooth the edges of the wrapped, or clad, foam i.e., the insulation layer. This approach may pose challenges in that air gaps, if any, between the cut insulation layer and the cladding could lead to a ripping, tearing, deterioration or even failure of one or both of the cladding and the insulation layer. Moreover, although a skilled technician may be used for implementing this approach to ducting i.e., for installing the insulation layer on the exterior surface of the duct, in most cases, a final fit and finish of the assembled duct may still be less than optimum and therefore, may have poor aesthetics. Moreover, performing duct work using this method does not protect the duct work from impact as deterioration can be caused by simple loads, for example, foot traffic i.e., by one or more persons stepping on or over the duct, or by setting of tools on the exterior surfaces of the duct during routine maintenance. Moreover, a warranty period for the AP™ Foil-Faced Polyiso Foam Sheathing, if installed properly, is prescribed to be ten years which is less than one-third the typical life expectancy of the duct itself thus requiring frequent replacement and/or repair to continue maintaining optimum thermal efficiency for the installation.

Many approaches to ducting have been implemented in the past to overcome one drawback or another. However, these previously known approaches may be regarded by some as being a chore while for others, they may be considered tedious, or at least cumbersome, activities to undertake. Also, an amount of strength and durability in the construction of and, consequently, a reliability of the duct assembly in operation may also be less than optimal with the use of these approaches. In fact, duct assemblies obtained with the use of these traditional approaches may be of poor structural integrity as well and, in most cases, would consequently be incapable of providing support to technicians, or other components in the vicinity of the duct, for example, these other components may need to be supported by the duct, or when these technicians would need access to those other components and may need to walk over the duct.

Keeping the foregoing discussion in view, it would, therefore, be prudent to implement a ducting system that is simple to manufacture, or assemble, yet easy to install in a HVAC application. Further, in view of the aforementioned drawbacks, there also exists a need for a ducting system that is robust in construction and that which, owing to its construction, can easily support other structures, or technicians, thereon and still obviates the need for extraneous manual effort that was typically incurred in the manufacture and installation of previously known duct assemblies.

SUMMARY

To overcome the above-mentioned limitations and problems, the present disclosure provides a ducting system for an exterior rated insulated duct work for any HVAC application that can be manufactured fairly easily and quickly without the need for extraneous manual effort compared to traditionally known duct assemblies. Also, the present disclosure provides a ducting system that offers pleasing aesthetics while also being robust in construction.

An embodiment of the present disclosure provides a ducting system for a HVAC application. The ducting system includes a duct assembly having an inner duct member and an outer duct member disposed around the inner duct member such that the outer and inner duct members together define a pre-determined amount of space therebetween. The ducting system also includes a bonding and insulation composite that is disposed in the pre-determined amount of space between the inner and outer duct members to insulate the inner and outer duct members from each other yet adhesively bond with each of the inner and outer duct members for imparting structural rigidity to the duct assembly.

According to an aspect of the present disclosure, the ducting system further includes a pair of adjacently located duct assemblies that are connected to each other by butting corresponding ones of inner and outer duct members from the pair of adjacently located duct assemblies with an interfacing gasket therebetween.

According to another aspect of the present disclosure, the outer duct member of each duct assembly includes an end that is configured to define thereon, a transverse duct flange (TDF) such that, in use, the TDF from one duct assembly is connected to a proximally located, and mutually opposing, TDF of another duct assembly from the pair of adjacently located duct assemblies.

According to another aspect of the present disclosure, the outer duct member is concentrically located with respect to the inner duct member. According to a further aspect of the present disclosure, the ducting system may include a plurality of jigs disposed within the pre-determined amount of space between the inner and outer duct members. Each jig from the plurality of jigs is configured to connect the outer duct member and the inner duct member such that the pre-determined amount of space between the inner and outer duct members is uniform across a cross-sectional area of the duct assembly.

According to another aspect of the present disclosure, a width of the space is based on a desired amount of R-value between the inner and outer duct members.

According to another aspect of the present disclosure, the bonding and insulation composite is deposited within the pre-determined amount of space as flowable media, and the flowable media expands and hardens into a non-flowable state over a pre-determined period of time prior to installation of the duct assembly within the HVAC application.

According to another aspect of the present disclosure, the bonding and insulation composite is formed using a mixture having an R-value of not less than 13 if the width of the space between the outer and inner duct members is 2 inches.

According to another aspect of the present disclosure, the bonding and insulation composite is formed using a closed-cell Polyurethane and resin mixture.

According to another aspect of the present disclosure, the bonding and insulation composite is a thermal and fluid impermeable insulation that is configured to hermetically seal the space between the inner and outer duct members.

Another embodiment of the present disclosure provides a method for forming a ducting system for a HVAC application. The method includes forming a duct assembly by providing an inner duct member. Further, the method also includes positioning an outer duct member around, and co-axially with, the inner duct member such that the outer and inner duct members together define a pre-determined amount of space therebetween. Furthermore, the method also includes providing a bonding and insulation composite in the pre-determined amount of space between the inner and outer duct members such that the bonding and insulation composite insulates the inner and outer duct members from each other yet adhesively bonds with each of the inner and outer duct members for imparting structural rigidity to the duct assembly.

According to an aspect of the present disclosure, the method further includes providing a pair of adjacently located duct assemblies and connecting the pair of adjacently located duct assemblies to each other by butting corresponding ones of the inner and outer duct members from the pair of adjacently located duct assemblies with an interfacing gasket therebetween.

According to an aspect of the present disclosure, the method further includes forming a transverse duct flange (TDF) on an end of the outer duct member of each duct assembly, and connecting the TDF from one duct assembly to a proximally located, and mutually opposing, TDF of another duct assembly from the pair of adjacently located duct assemblies.

According to an aspect of the present disclosure, the method further includes locating the outer duct member concentrically with respect to the inner duct member. According to a further aspect of the present disclosure, the method further includes providing a plurality of jigs within the pre-determined amount of space to connect the outer duct member and the inner duct member such that the pre-determined amount of space between the inner and outer duct members is uniform across a cross-sectional area of the duct assembly.

According to another aspect of the present disclosure, a width of the space is based on a desired amount of R-value between the inner and outer duct members.

According to another aspect of the present disclosure, providing the bonding and insulation composite within the pre-determined amount of space includes depositing the bonding and insulation composite within the pre-determined amount of space as flowable media and allowing the flowable media to expand and harden into a non-flowable state over a pre-determined period of time prior to installation of the duct assembly within the ducting system.

According to another aspect of the present disclosure, the method further includes using a mixture to form the bonding and insulation composite such that the bonding and insulation composite has an R-value of not less than 13 if the width of the space between the outer and inner duct members is 2 inches.

According to another aspect of the present disclosure, the bonding and insulation composite is formed using a closed-cell Polyurethane and resin mixture.

According to another aspect of the present disclosure, the bonding and insulation composite is a thermal and fluid impermeable insulation that is configured to hermetically seal the space between the inner and outer duct members.

Other and further aspects and features of the disclosure will be evident from reading the following detailed description of the embodiments, which are intended to illustrate, not limit, the present disclosure.

BRIEF DESCRIPTION OF THE DRAWINGS

The illustrated embodiments of the disclosed subject matter will be best understood by reference to the drawings, wherein like parts are designated by like numerals throughout. The following description is intended only by way of example, and simply illustrates certain selected embodiments of devices and processes that are consistent with the disclosed subject matter as claimed herein.

FIG. 4A is a flowchart of a sub-routine pursuant to the method of FIG. 3 in accordance with an exemplary embodiment of the present disclosure while

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Reference throughout this specification to "a embodiment," "an embodiment," or "one embodiment" means that a particular feature, structure, or characteristic described in connection with the embodiment is included in at least one embodiment of the disclosed subject matter. Thus, appearances of the phrases "in an embodiment" or "in one embodiment" in various places throughout this specification are not necessarily referring to the same embodiment.

Furthermore, the described features, structures, or characteristics may be combined in any suitable manner in one or more embodiments. In the following description, numerous specific details are provided, to provide a thorough understanding of embodiments of the disclosed subject matter. One skilled in the relevant art will recognize, however, that the disclosed subject matter can be practiced without one or more of the specific details, or with other structures, components, and materials as substitution or replacement to the structures, components, materials disclosed herein. In other instances, one or more structures, components, and materials disclosed herein may altogether be omitted, and equivalent structures, components, materials may be used in lieu thereof. Also, in the present disclosure, well-known structures, materials, or operations are not shown or described in detail to avoid obscuring aspects of the disclosed subject matter.

Figure 1:
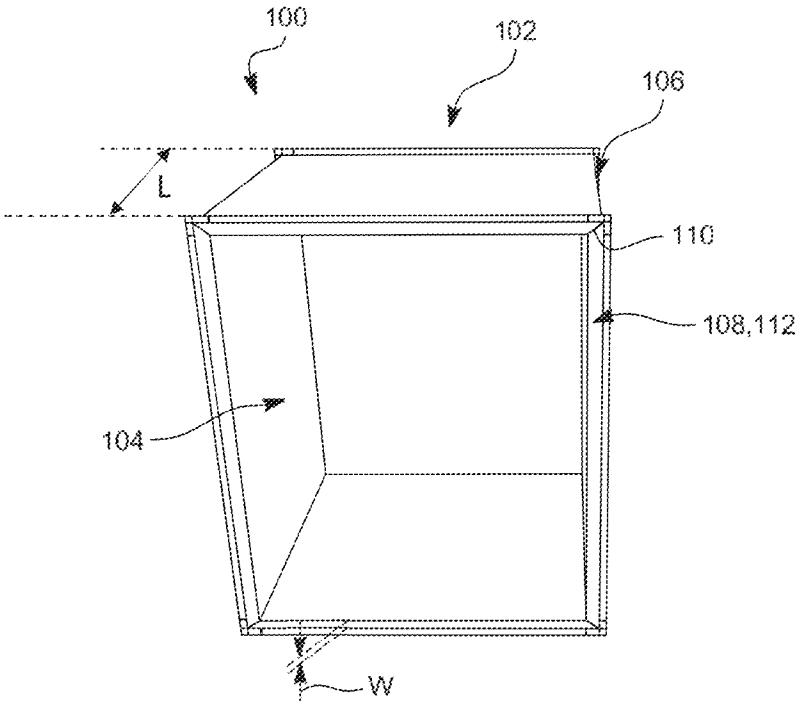
FIG. 1 is a front perspective view of a ducting system for a HVAC application, in accordance with an embodiment of the present disclosure.

FIG. 1 shows a front perspective view of a ducting system 100 for a HVAC application, in accordance with an embodiment of the present disclosure. As shown, the ducting system 100 includes a duct assembly 102 having an inner duct member 104 and an outer duct member 106 disposed around the inner duct member 104.

In embodiments herein, each of the inner and outer duct members 104, 106 may be made from similar or dissimilar metallic materials such as galvanized steel, stainless steel, or aluminum, but is not limited thereto. It is hereby envisioned that a specific choice of materials used to form respective ones of the inner and outer duct members 104, 106 may be based on various factors including costs per unit length and environmental factors present at a location, for example, a site at which the installation is to be made. Although some factors have been disclosed herein, a number of factors is not limited thereto, and persons skilled in the art will acknowledge that other factors may be taken into consideration and such factors determining a choice of material/s for forming the inner and outer duct members 104, 106 may not be construed as being limiting of this disclosure in any way. In embodiments herein, the outer and inner duct members 106, 104 together define a pre-determined amount of space 108 therebetween. In a further embodiment as shown in the view of FIG. 1, the outer duct member 106 is concentrically located with respect to the inner duct member 104. In this embodiment, the ducting system 100 may also include a plurality of jigs 110 that are disposed within the pre-determined amount of space 108 between the inner and outer duct members 104, 106. The jigs 110 are made to keep the inner and outer ducts 104 and 106 aligned and spaced properly. Without the jigs 110, the polyurethane insulation material may warp or bend one of the sides. The jigs 110 are particularly necessary at the ends where one assembly may meet with another and all the surfaces need to line up properly.

Each jig 110 is configured to connect the outer duct member 106 and the inner duct member 104 such that the pre-determined amount of space 108 between the inner and outer duct members 104, 106 is uniform across a cross-sectional area of the duct assembly 102. Moreover, the jigs 110 also help to keep intact a straightness of each of the inner and outer duct members 104, 106, or stated differently, the jigs 110 help to maintain the inner and outer duct members 104, 106 rigidly in their respective positions and therefore, maintain not only a straightness of each of the inner and outer duct members 104, 106 but also consequently maintain the uniformity of the space between the inner and outer duct members 104, 106.

Further, the ducting system 100 includes a bonding and insulation composite 112 that is disposed in the pre-determined amount of space 108 between the inner and outer duct members 104, 106 to insulate the inner and outer duct members 104, 106 from each other yet adhesively bond with each of the inner and outer duct members 104, 106 for imparting structural rigidity to the duct assembly 102.

In an embodiment, a width 'W' of the space 108 is based on a desired amount of R-value i.e., the thermal resistance per unit width of the space 108 between the inner and outer duct members 104, 106.

In an embodiment, during a manufacture of the ducting system 100, the bonding and insulation composite 112 would be deposited within the pre-determined amount of space 108 as flowable media, and the flowable media would be allowed to expand and harden into a non-flowable state over a pre-determined period of time prior to installation of the duct assembly 102 within the HVAC application. The pre-determined period of time disclosed herein may range from a few seconds to a few minutes, for example, approximately in the range of 5 seconds to 5 minutes.

In an embodiment, the bonding and insulation composite 112 is formed using a mixture having an R-value of not less than 13 if the width 'W' of the space 108 between the outer and inner duct members 106, 104 is 2 inches.

In an embodiment, the bonding and insulation composite 112 is formed using a closed-cell Polyurethane and resin mixture.

In an embodiment, the bonding and insulation composite 112 is a thermal and fluid impermeable insulation that is configured to hermetically seal the space 108 between the inner and outer duct members 104, 106. It is hereby envisioned that the thermal and fluid impermeability of the bonding and insulation composite 112 would prevent movement of heat and a fluid, for example, water or air across or through the composite 112 and hence, the bonding and insulation composite 112 would be beneficially rendered in a weather resistant manner.

Figure 2:
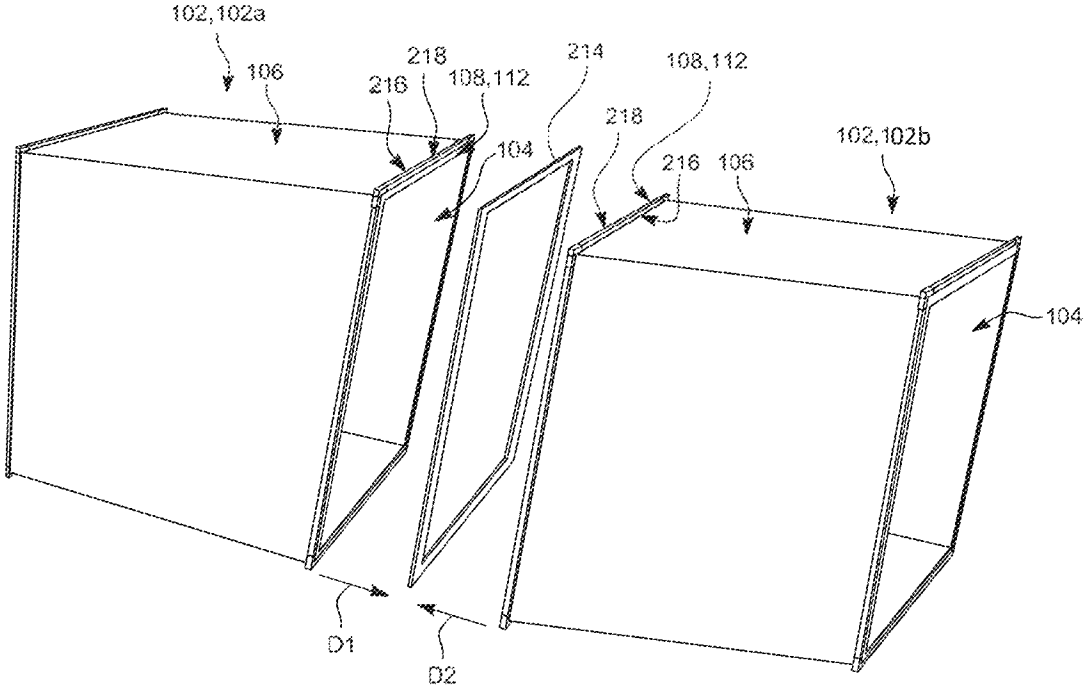
FIG. 2 is a side perspective view of a ducting system, in accordance with an embodiment of the present disclosure.

FIG. 2 shows a side perspective view of the ducting system 100 showing a pair of adjacently located duct assemblies 102*a*, 102*b* prior to being connected with each other, in accordance with an embodiment of the present disclosure. In the embodiment illustrated in the view of FIG. 2, the pair of adjacently located duct assemblies 102*a*, 102*b* may be connected to each other by butting corresponding ones of outer duct members 106 from the pair of adjacently located duct assemblies 102*a*, 102*b* with an interfacing gasket 214 therebetween. The interfacing gasket 214 may include an elastomer, or another polymer, for example, Butyl rubber, high density polyethylene (HDPE), low density polyethylene (LDPE), or may be formed using other suitable materials commonly known to persons skilled in the art. The interfacing gasket 214 is configured to act, or serve, as a hermetic seal between the pair of adjacently located duct assemblies 102*a*, 102*b* upon mutually opposed abutment thereof i.e., by the outer duct members 106 from the pair of adjacently located duct assemblies 102*a*, 102*b* as shown by a pair of directional arrows 'D1' and 'D2' in the view of FIG. 2.

Further, in this embodiment, the outer duct member 106 of each duct assembly 102 may include an end 216 that is configured to define thereon, a transverse duct flange (TDF) 218 such that, in use, the TDF 218 from one duct assembly 102*a* is connected to a proximally located, and mutually opposing, TDF 218 of another duct assembly 102*b* from the pair of adjacently located duct assemblies 102*a*, 102*b*.

In regards to the foregoing embodiment, only a pair of adjacently located duct assemblies 102*a*, 102*b* is depicted as part of the ducting system 100. However, in other embodiments, more than two duct assemblies 102, for example, three or more duct assemblies 102 may be positioned, and connected, in a successive manner. These successively positioned duct assemblies 102 may be connected by using a plurality of fastening arrangements (see FIG. 5H) that are configured to secure each pair of adjacently located duct assemblies 102*a*, 102*b*, . . . and so on from the plurality of successively positioned duct assemblies. In an embodiment, these fastening arrangements may include cleats that designed to clamp onto the pair of proximally located, and mutually opposing, flanges i.e., the TDF's 218 to secure each duct assembly 102 to a successive, and adjacently located, one of the duct assemblies 102, for example, duct assemblies, 102*a* and 102*b* that are present in the ducting system 100. Additionally, proximally located and mutually opposing flanges i.e., TDFs 218 may be secured to each other using one or more bolt and nut arrangements. Alternatively, these fastening arrangements may include rivets or other types of structures that are commonly known to persons skilled in the art and that can be readily implemented for use in securing each pair of adjacently located duct assemblies 102*a*, 102*b* . . . and so on that may be present in the plurality of successively positioned duct assemblies 102.

Figure 3:
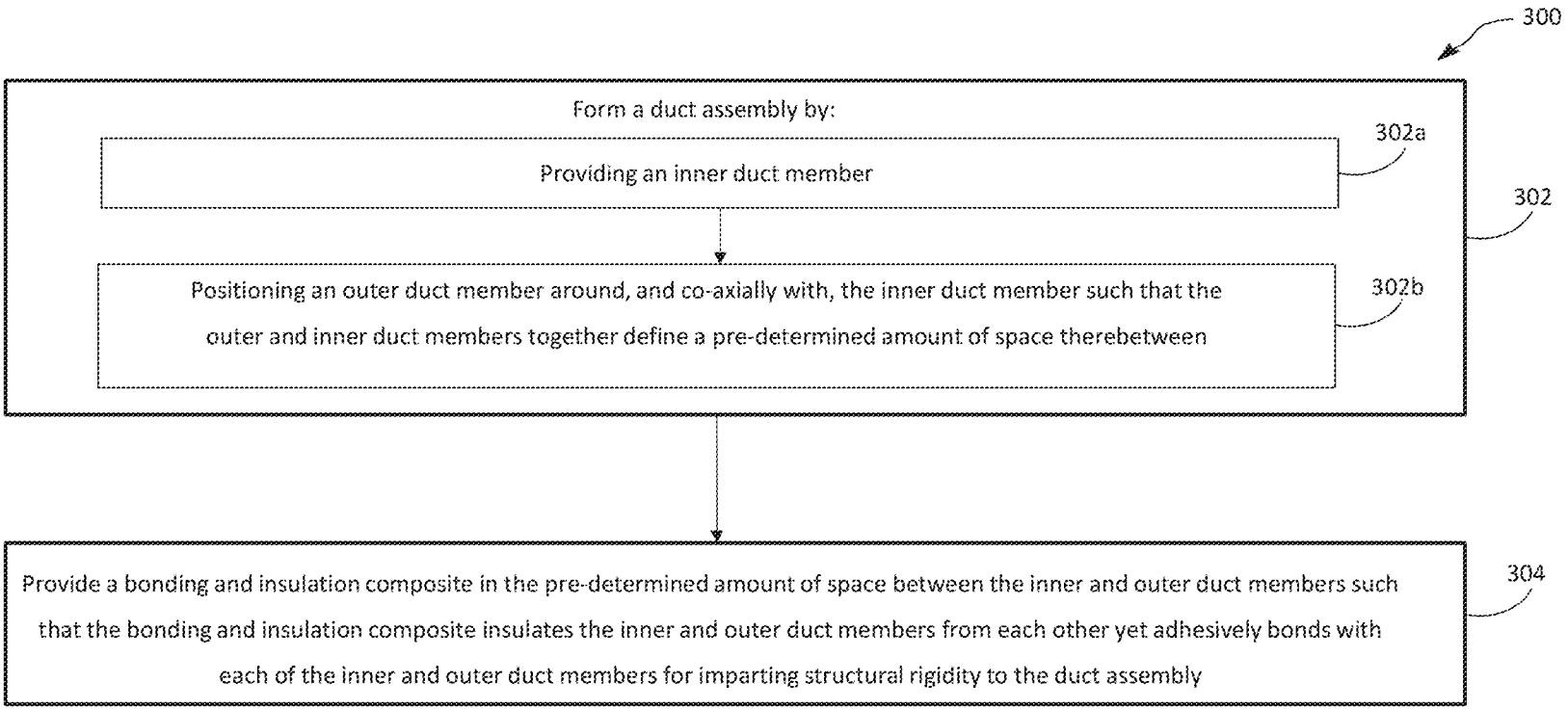
FIG. 3 is a flowchart of a method for forming the ducting system, in accordance with an embodiment of the present disclosure.
Figure 4A:
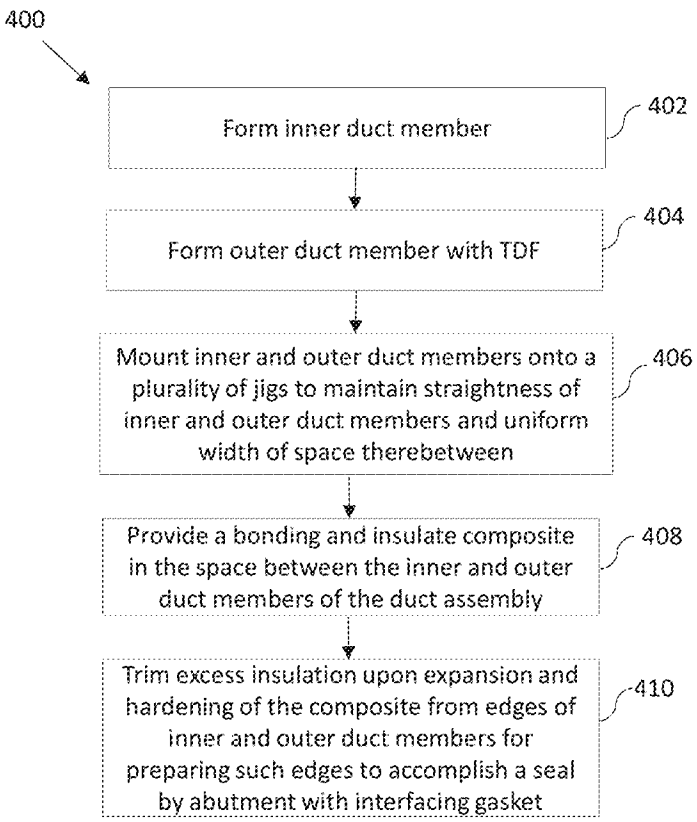
Figure 4B:
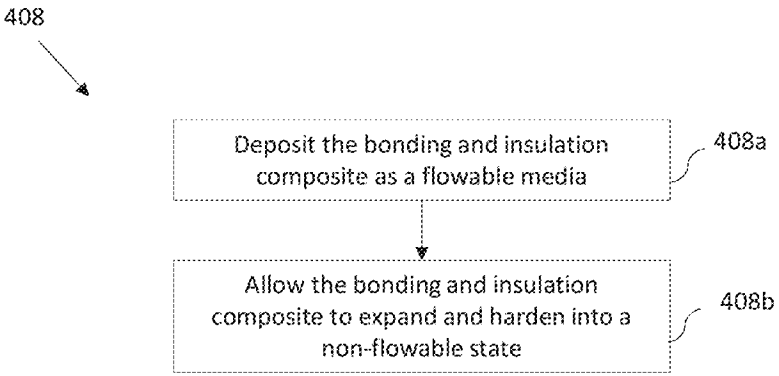
FIG. 4B is a flowchart pertaining to a step of the sub-routine of FIG. 4A.

FIG. 3 shows a flowchart of a method 300 showing steps 302-304 for forming the ducting system 100, in accordance with an embodiment of the present disclosure. FIG. 4A is a flowchart of a sub-routine 400 pursuant to carrying out the method 300 in accordance with an exemplary embodiment of the present disclosure while FIG. 4B is a flowchart of a further sub-routine pertaining to step 408 of the sub-routine 400 from FIG. 4A.

Referring to FIG. 3, at step 302, the method 300 includes forming the duct assembly 102 by providing the inner duct member 104 (see sub-step 302*a*) and positioning the outer duct member 106 around, and co-axially with, the inner duct member 104 such that the outer and inner duct members 106, 104 together define the pre-determined amount of space 108 therebetween (see sub-step 302*b*). Referring to FIG. 4A, the sub-routine 400 includes steps 402-406 that are in conformance to step 302 of the method 300. As shown, at step 402, the sub-routine 400 of the method 300 includes forming the inner duct member 104. Further, at step 404, the sub-routine 400 of the method 300 also includes forming the outer duct member 106 with the TDF 218 (shown in the view of FIG. 2) thereon. Furthermore, at step 406, the sub-routine 400 of the method 300 includes mounting the inner and outer duct members 104, 106 onto the plurality of jigs 110 for proper alignment i.e., to maintain straightness of the inner and outer duct members 104, 106 and a uniform width 'W' therebetween.

Furthermore, at step 304, the method 300 includes providing the bonding and insulation composite 112 in the pre-determined amount of space 108 between the inner and outer duct members 104, 106 such that the bonding and insulation composite 112 insulates the inner and outer duct members 104, 106 from each other yet adhesively bonds with each of the inner and outer duct members 104, 106 for imparting structural rigidity to the duct assembly 102, as similarly recited in the step 408 of the sub-routine 400 (see FIG. 4A). In the further sub-routine to the step 408 as shown by way of the flowchart in FIG. 4B, at step 408*a*, the bonding and insulation composite 112 is deposited as a flowable media. Thereafter, with continued reference to FIG. 4B, at step 408*b* in the further sub-routine to the step 408, the bonding and insulation composite 112 is allowed to expand and harden into a non-flowable state.

Now returning to FIG. 4A, at step 410, the excess insulation, upon expansion and hardening of the composite 112, is trimmed from edges of inner and outer duct members 104, 106 so that the insulation and bonding composite 112 is flush with the TDF 218 (see FIG. 2) i.e., for preparing the edges of the inner and outer duct members 104, 106 to accomplish a seal by abutment with the interfacing gasket 214.

In an embodiment, the method 300 may also include providing the pair of adjacently located duct assemblies 102*a*, 102*b* and connecting the pair of adjacently located duct assemblies 102*a*, 102*b* to each other by butting corresponding ones of the outer duct members 106 from the pair of adjacently located duct assemblies 102*a*, 102*b* with the interfacing gasket 214 therebetween (refer to FIG. 2).

In an embodiment, the method 300 may also include forming the transverse duct flange (TDF) 218 on the end 216 of the outer duct member 106 of each duct assembly 102, and connecting the TDF 218 from one duct assembly 102 to a proximally located, and mutually opposing, TDF 218 of another duct assembly 102 from the pair of adjacently located duct assemblies 102*a*, 102*b* (refer to FIG. 2).

In an embodiment, the method 300 may further include locating the outer duct member 106 concentrically with respect to the inner duct member 104. In this embodiment, the method 300 may further include providing the plurality of jigs 110 within the pre-determined amount of space 108 to connect the outer duct member 106 and the inner duct member 104 such that the pre-determined amount of space 108 between the inner and outer duct members 104, 106 is uniform across the cross-sectional area of the duct assembly 102.

As disclosed herein, in an embodiment, the width 'W' of the space 108 is based on a desired amount of R-value between the inner and outer duct members 104, 106.

In an embodiment, as shown by way of a flowchart for step 304 in the view of FIG. 4B, the step 304 of providing the bonding and insulation composite 112 within the pre-determined amount of space 108 includes, at step 408*a*, depositing the bonding and insulation composite 112 as flowable media within the pre-determined amount of space 108, and at step 408*b*, hardening the flowable media into a non-flowable state over a pre-determined period of time prior to installation of the duct assembly 102 within the ducting system 100.

Also, as disclosed earlier by way of embodiments herein, the method 300 may further include using a mixture to form the bonding and insulation composite 112 such that the bonding and insulation composite 112 has an R-value of not less than 13 if the width 'W' of the space 108 between the outer and inner duct members 106, 104 is 2 inches, i.e., R of approximately 6.8 per inch. Further, the bonding and insulation composite 112 is formed using a closed-cell Polyurethane and resin mixture. Further, this bonding and insulation composite 112 is a thermal and fluid impermeable insulation that is configured to hermetically seal the space 108 between the inner and outer duct members 104, 106. Furthermore, in embodiments herein, the mixture may be poured, or filled, into the space 108 in small increments relative to a length 'L' of the duct assembly 102 (refer to FIG. 1). The pouring of the mixture in small increments compared to the length 'L' of the duct assembly 102 ensures a complete coverage of the space 108 by the mixture while preventing any air gaps or allowing the inner and/or outer duct members 104, 106 to warp or bend when the mixture i.e., the bonding and insulation composite 112 hardens into the non-flowable state. Additionally, as disclosed earlier herein, upon hardening, any excess bonding and insulation composite 112 may be trimmed off from edges of the inner and outer duct members 104, 106 so as to allow ends of the composite 112 to be flush with the edges of the inner and outer duct members 104, 106. Additionally, the trimmed ends of the composite 112 that are now flush with the edges of the inner and outer duct members 104, 106 could also be sealed off with a coat of paint to enhance the amount of durability of the ducting system 100 so that the ducting system 100 is rendered capable of withstanding and/or enduring forces typically encountered when in transit i.e., when being transported from one location to another.

It is hereby envisioned that with implementation and use of embodiments herein, the insulation and bonding composite 112, once deposited and hardened within the space 108 between the inner and outer duct members 104, 106 of the ducting system 100, can provide added strength to the ducting system 100 so as to allow an exterior surface of the ducting system 100 to be used as a walkway for technicians, or even pedestrians, that may choose to walk on or over an area where the ducting system 100 is installed. Also, with use of the inner and outer duct members 104, 106, the ducting system 100 can be washed and/or cleaned, both on an inside and an outside of the ducting system 100, using water, other cleaning agents/chemicals, and with any other method commonly known to persons skilled in the art including high pressure washing.

Figure 5A:
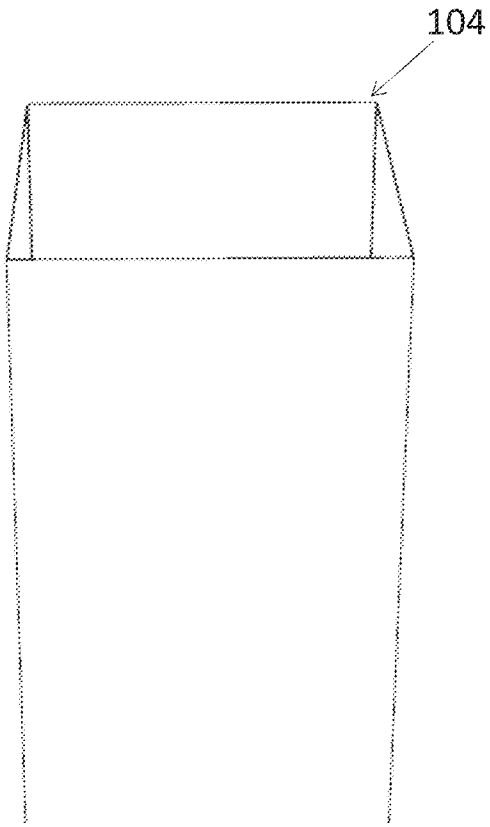
FIGS. 5A-5I are diagrammatic representations for illustrating a process of manufacturing the ducting system pursuant to the method of FIG. 3.

FIGS. 5A-5I are diagrammatic representations illustrating a process of manufacturing the ducting system 100 pursuant to the method of FIG. 3. In particular, FIG. 5A illustrates a top perspective view of the inner duct member 104. For manufacturing the ducting system 100, the process is started by forming the inner duct member 104 to required specifications i.e., a size, shape, and choice of materials, as dictated by one or more drawings, depending on specific requirements for use in a HVAC application. For example, the inner duct member 104 can be formed from suitable metallic materials including, but not limited to, Aluminum, Galvanized steel or Stainless Steel (SS) based on the HVAC application.

Figure 5C:
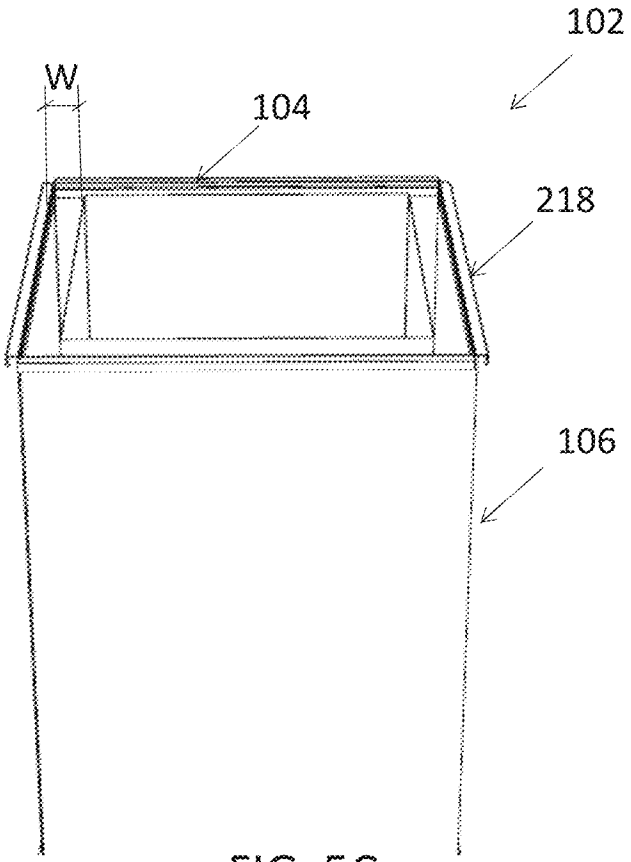
Figure 5B:
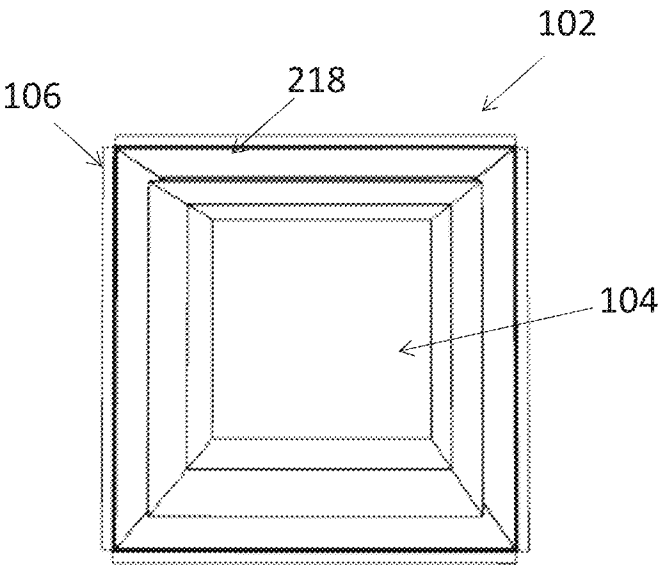

FIGS. 5B and 5C illustrate front and top perspective views of the duct assembly 102. Upon forming the inner duct member 104 as depicted in the view of FIG. 5A, the outer duct member 106 is formed with the transverse duct flange (TDF) 218 thereon. Moreover, when forming the outer duct member 106, a size of the outer duct member 106 is selected so as to allow the inner and outer duct members 104, 106 to define the pre-determined amount of space 108 therebetween i.e., upon placing the formed outer duct member 106 co-axially with the inner duct member 104. In order to maintain the co-axial positioning of the outer duct member 106 with the inner duct member 104 i.e., for maintaining a straightness of individual ones of the inner and outer duct members 104, 106 and the uniform width 'W' of the space 108 between the inner and outer duct members 104, 106, spacing jigs 110 are used (see FIG. 2) between the inner and outer duct members 104, 106. It may be noted that the TDF 218 is integral to the outer duct member 106. Moreover, the outer duct member 106 may be formed from materials that are similar, or dissimilar, to that used for forming of the inner duct member 104 for purposes of cost, aesthetics, or durability. For example, a pharmaceutical facility that needs to have the inner duct member 104 made from stainless steel for moving a corrosive gas from one location to another does not need the outer duct member 106 to be made necessarily from stainless steel.

Figure 5E:
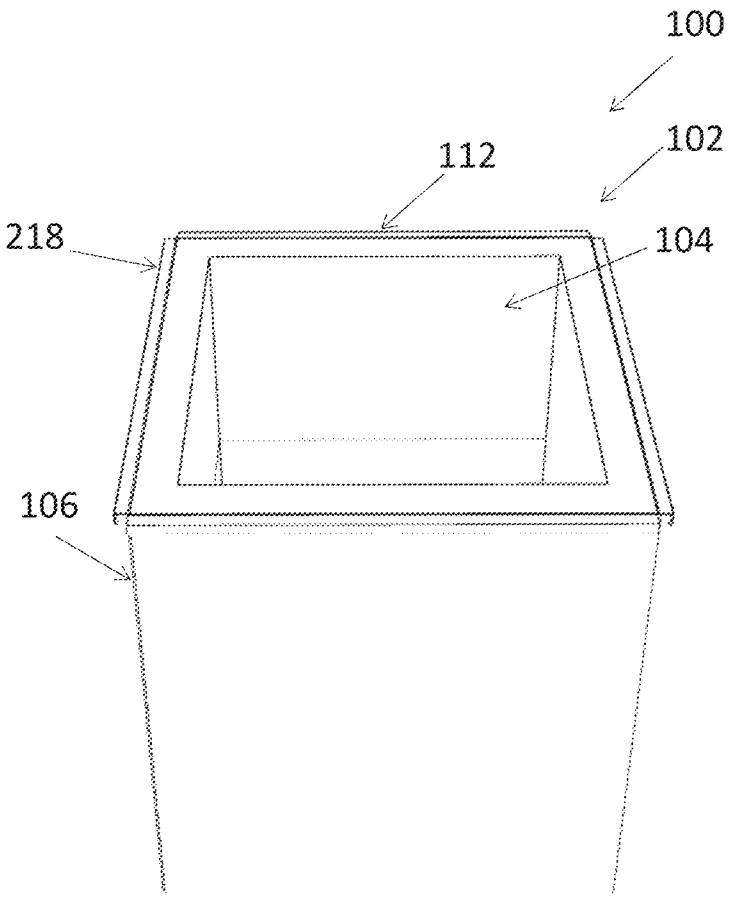
Figure 5D:
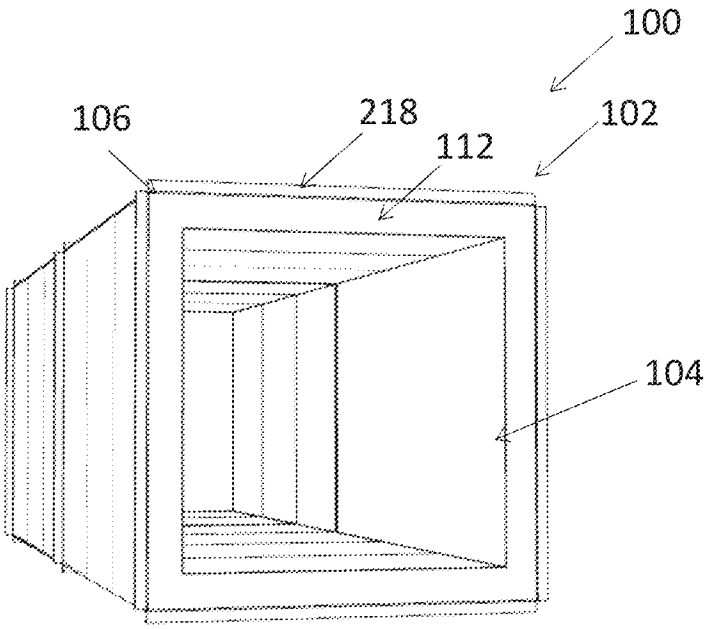

FIGS. 5D and 5E illustrate front and top perspective views of the duct assembly 102 provided with the bonding and insulation composite 112 for forming the ducting system 100. In embodiments of the present disclosure, the bonding and insulation composite 112 is rated at R-6.8 per inch and is a closed cell Polyurethane based pourable foam which hardens to a density that provides at least over 50 pounds per square inch (PSI) when binding the inner and outer duct members 104, 106 together. The bonding and insulation composite 112 is waterproof when fully cured. Moreover, the bonding and insulation composite 112 may be ridged when fully cured as the flowable media i.e., the foam mixture is poured in lifts of, for example, 6-10 inches at a time for ensuring complete coverage of the width 'W' i.e., without causing air gaps to occur while also preventing the foam from bending one or both of the inner and outer duct members 104, 106 as the foam expands and cures within the space 108. When the insulation composite has cured, it is sawn off, flat, to remain at the level of the duct assembly 102 so that the duct assembly 102 is ready to be joined with an adjacently located duct assembly 102 (see FIGS. 2 and 5H). The end of the insulation composite 112 that is flush with the end of the duct assembly 102 may also be sealed off with a coat of protective paint for improved durability of the duct assembly 102 in transit i.e., during shipment.

Figure 5F:
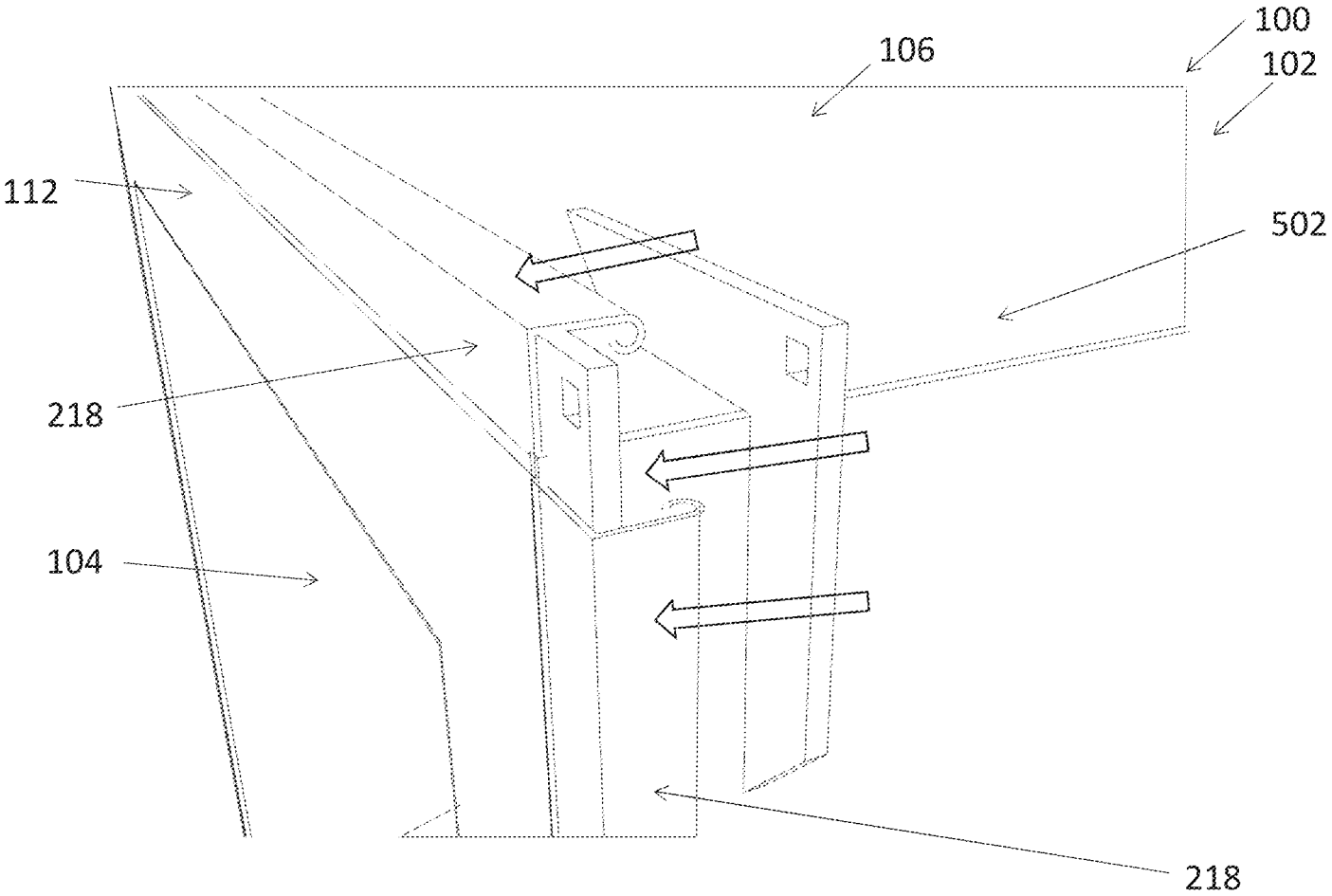

FIG. 5F illustrates a side perspective view of the ducting system 100 just prior to installing a corner bracket 502 on the ducting system 100. Each corner of the duct assembly 102 i.e., a space between the outer duct member 106 and the TDF 218 formed thereon is installed with the corner bracket 502. Upon setting the corner brackets 502 in place, the TDF 218 is crimped around the corner bracket 502 to prevent any relative movement and the installation of the corner bracket 502 to the ducting system 100 is secured in a permanent manner.

Figure 5G:
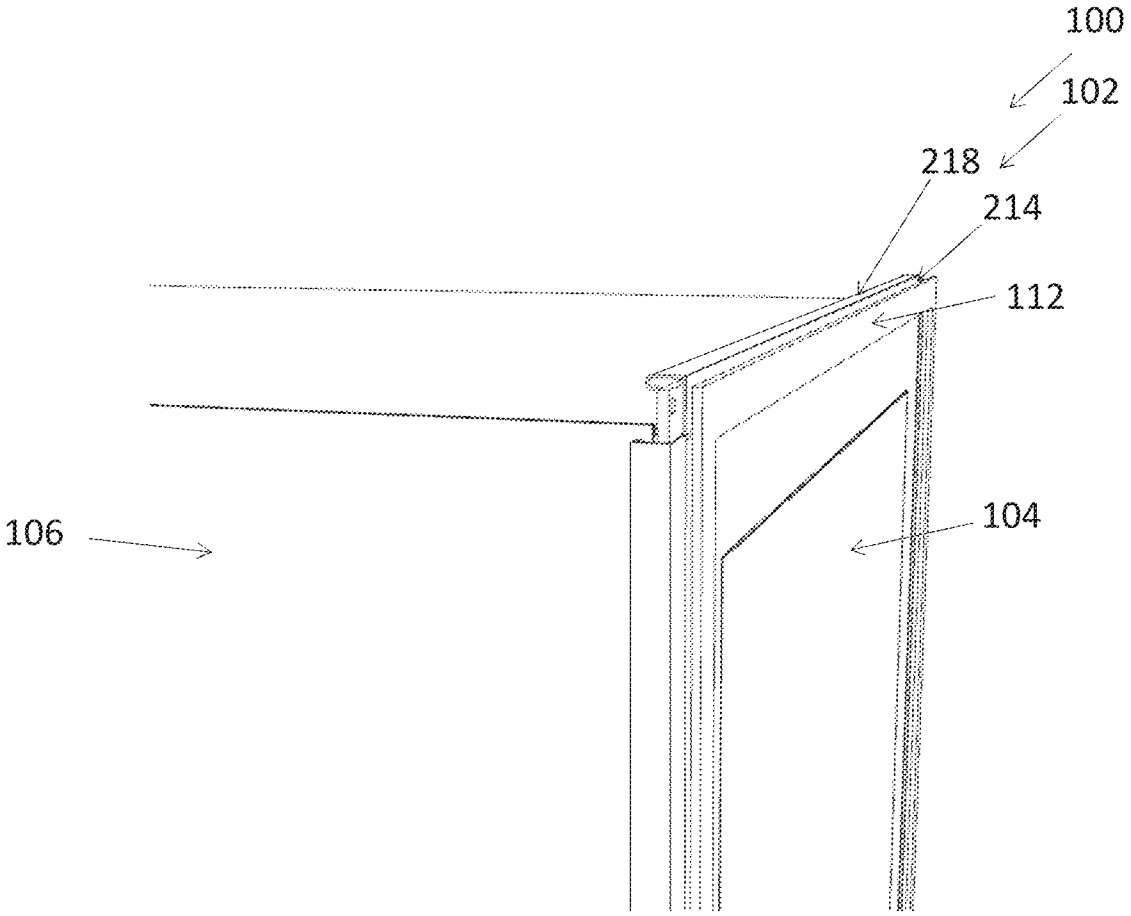

FIG. 5G illustrates a side perspective view of the ducting system 100 showing the interfacing gasket 214 being provided thereon. A material of the interfacing gasket 214 is, for example, Butyl rubber that is malleable i.e., flexible and will compress and seal the pair of adjacently located duct assemblies 102*a*, 102*b* (see FIGS. 2 and 5H) making them air tight. Since each duct assembly 102*a*, 102*b* has been formed as a single or unitary piece, the interfacing gasket 214 can be easily located on the TDF 218 of one of the duct assemblies 102*a*/102*b* and advantageously only one interfacing gasket 214 is required for sealing the pair of adjacently located duct assemblies 102*a*, 102*b*.

Figure 5H:
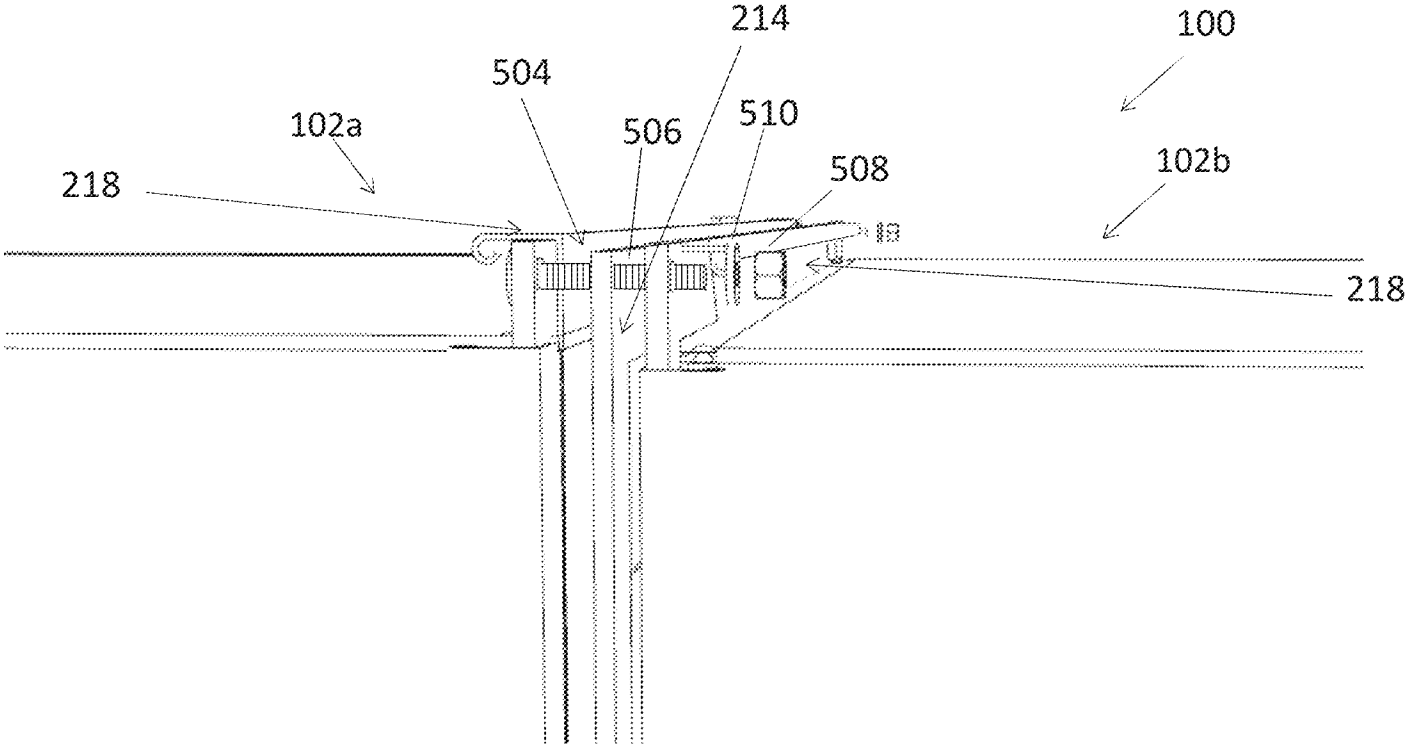

FIG. 5H illustrates a side perspective view of the ducting system 100 showing the pair of duct assemblies 102*a*, 102*b* being fastened to each other using a plurality of fastening arrangements 504. For example, as shown in the view of FIG. 5H, the adjacently located duct assemblies 102*a*, 102*b* can be butted up against each other with the interfacing gasket 214 therebetween and the fastening arrangements are installed to pull the two duct assemblies 102*a*, 102*b* together for compressing the gasket 214 therebetween. Moreover, as shown, each fastening arrangement 504 may include a carriage bolt 506, a nut 508 and a washer 510, but is not limited thereto. As disclosed earlier herein, a type of fastening arrangement 504 used is merely explanatory in nature and hence, non-limiting of this disclosure. In other embodiments, other types of fastening arrangements including, but not limited to, rivets may be suitably employed in lieu of the bolt and nut arrangement disclosed herein.

Figure 5I:
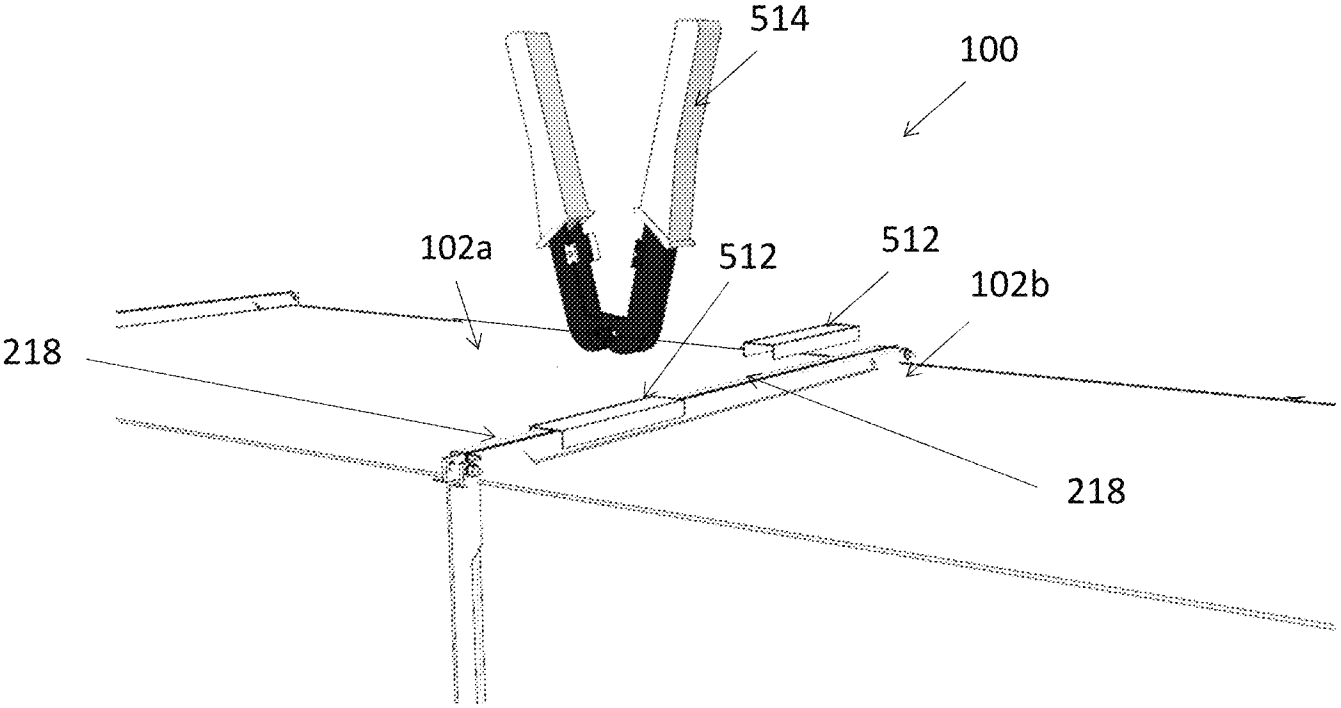

FIG. 5I illustrates a side perspective view of the ducting system 100 showing TDFs 218 from the pair of adjacently located duct assemblies 102*a*, 102*b* being clamped using a plurality of metal cleats 512 for securing the pair of adjacently located duct assemblies 102*a*, 102*b*. Each of these cleats 512 is precisely cut and bent to fit tightly over the butted TDFs 218 from the pair of adjacently located duct assemblies 102*a*, 102*b*. Once positioned, a crimp tool 514 is used to bend the cleats 512 over the butted TDFs 218 so the only way to remove them would be to bend them back off i.e., in a manner opposite to that used for bending the cleats 512 over the butted TDFs 218. A number of cleats required for use in securing the butted TDFs 218, depends on a length of the seams between adjacently located duct assemblies 102*a*, 102*b* i.e., along a perimeter of the butted TDFs 218. In embodiments herein, it is contemplated that these cleats should be installed at intervals of about every 6-10 inches along a perimeter of the butted TDFs 218.

It will be appreciated that features of the present disclosure are susceptible to being combined in various configurations without departing from the scope of the present disclosure as defined by the appended claims. Also, various presently unforeseen or unanticipated alternatives, modifications, variations, or improvements therein may be subsequently made by those skilled in the art, which are also intended to be encompassed by the following claims.

The above description does not provide specific details of manufacture or design of the various components. Those of skill in the art are familiar with such details, and unless departures from those techniques are set out, techniques known, related art or later developed designs and materials should be employed. Those in the art are capable of choosing suitable manufacturing and design details. The terminology used herein is for the purpose of describing particular embodiments only and is not intended to be limiting of the disclosure.

What is claimed is:

1. A ducting system for a heating, venting and air conditioning (HVAC) application, the ducting system comprising:
- a duct assembly for the HVAC application comprising:
  - a metallic inner duct member, and
  - a metallic outer duct member disposed around, and co-axially with, the inner duct member such that the outer and inner duct members together define a pre-determined amount of space contiguously therebetween; and
- a bonding and insulation composite disposed in the pre-determined amount of space between the inner and outer duct members to insulate the inner and outer duct members from each other yet adhesively bond with each of the inner and outer duct members so as to impart structural rigidity to the duct assembly, wherein the bonding and insulation composite is:
  - a closed-cell Polyurethane and resin mixture formed within the pre-determined amount of space contiguously between the inner and outer duct members such that the contiguously formed bonding and insulation composite is a thermal and fluid impermeable insulation configured to hermetically seal the space between the inner and outer duct members; and
- an interfacing gasket disposed on at least one end of the duct assembly, wherein the interfacing gasket is a polymer.

2. The ducting system of claim 1 further comprising a pair of adjacently located duct assemblies that are connected to each other by butting corresponding ones of inner and outer duct members from the pair of adjacently located duct assemblies with the interfacing gasket therebetween.

3. The ducting system of claim 2, wherein the outer duct member of each duct assembly includes an end that is configured to define thereon, a transverse duct flange (TDF) such that, in use, the TDF from one duct assembly is connected to a proximally located, and mutually opposing, TDF of another duct assembly from the pair of adjacently located duct assemblies.

4. The ducting system of claim 1, wherein the outer duct member is concentrically located with respect to the inner duct member.

5. The ducting system of claim 4 further comprising a plurality of jigs disposed within the pre-determined amount of space between the inner and outer duct members, each jig from the plurality of jigs configured to connect the outer duct member and the inner duct member such that the pre-determined amount of space between the inner and outer duct members is uniform across a cross-sectional area of the duct assembly.

6. The ducting system of claim 5, wherein a width of the space is based on a desired amount of R-value between the inner and outer duct members.

7. The ducting system of claim 6, wherein the bonding and insulation composite is formed using a mixture having an R-value of not less than 13 if the width of the space between the outer and inner duct members is 2 inches.

8. The ducting system of claim 1, wherein the bonding and insulation composite is deposited within the pre-determined amount of space as flowable media, and wherein the flowable media expands and hardens into a non-flowable state over a pre-determined period of time prior to installation of the duct assembly within the HVAC application.

9. A method for forming a ducting system for a heating, venting and air conditioning (HVAC) application, the method comprising:
- forming a duct assembly for the HVAC application by:
  - providing a metallic inner duct member; and
  - positioning a metallic outer duct member around, and co-axially with, the inner duct member such that the outer and inner duct members together define a pre-determined amount of space contiguously therebetween; and
- providing a bonding and insulation composite within the pre-determined amount of space between the inner and outer duct members such that the bonding and insulation composite contiguously insulates the inner and outer duct members from each other yet adhesively bonds with each of the inner and outer duct members for imparting structural rigidity to the duct assembly, wherein the bonding and insulation composite is:

a closed-cell Polyurethane and resin mixture formed within the pre-determined amount of space contiguously between the inner and outer duct members such that the contiguously formed bonding and insulation composite is a thermal and fluid impermeable insulation configured to hermetically seal the space between the inner and outer duct members; and providing an interfacing gasket on at least one end of the duct assembly, wherein the interfacing gasket is a polymer.

10. The method of claim 9 further comprising:

providing a pair of adjacently located duct assemblies; and connecting the pair of adjacently located duct assemblies to each other by butting corresponding ones of the outer duct members from the pair of adjacently located duct assemblies with the interfacing gasket therebetween.

11. The method of claim 10 further comprising:

forming a transverse duct flange (TDF) on an end of the outer duct member of each duct assembly; and connecting the TDF from one duct assembly to a proximally located, and mutually opposing, TDF of another duct assembly from the pair of adjacently located duct assemblies.

12. The method of claim 9 further comprising locating the outer duct member concentrically with respect to the inner duct member.

13. The method of claim 12 further comprising providing a plurality of jigs within the pre-determined amount of space to connect the outer duct member and the inner duct member such that the pre-determined amount of space between the inner and outer duct members is uniform across a cross-sectional area of the duct assembly.

14. The method of claim 13, wherein a width of the space is based on a desired amount of R-value between the inner and outer duct members.

15. The method of claim 14 further comprising using a mixture to form the bonding and insulation composite such that the bonding and insulation composite has an R-value of not less than 13 if width of the space between the outer and inner duct members is 2 inches.

16. The method of claim 9, wherein providing the bonding and insulation composite within the pre-determined amount of space includes depositing the bonding and insulation composite within the pre-determined amount of space as flowable media, and allowing the flowable media to expand and harden into a non-flowable state over a pre-determined period of time prior to installation of the duct assembly within the ducting system.

* * * * *